US010201204B2

(12) United States Patent
Zheng et al.

(10) Patent No.: US 10,201,204 B2
(45) Date of Patent: Feb. 12, 2019

(54) LIGHT-EMITTING HELMET AND MANUFACTURING METHOD THEREOF

(71) Applicant: Shenzhen Qianhai LIVALL IoT Technology Co., Ltd., Shenzhen, Guangdong Province (CN)

(72) Inventors: Bo Zheng, Shenzhen (CN); Yong-Zheng Ye, Shenzhen (CN); Jie Tian, Jiujiang (CN); Zhi-Ming Li, Nanchong (CN); Xiang-Ling Yi, Xiamen (CN)

(73) Assignee: SHENZHEN QIANHAI LIVALL IOT TECHNOLOGY CO., LTD., Shenzhen, Guangdong Province (CN)

( * ) Notice: Subject to any disclaimer, the term of this patent is extended or adjusted under 35 U.S.C. 154(b) by 37 days.

(21) Appl. No.: 15/390,670

(22) Filed: Dec. 26, 2016

(65) Prior Publication Data

US 2017/0196289 A1 Jul. 13, 2017

(30) Foreign Application Priority Data

Jan. 9, 2016 (CN) ..... 2016 1 0010916

(51) Int. Cl.

| | |
|---|---|
| ***A42B 3/04*** | (2006.01) |
| ***A42B 3/06*** | (2006.01) |
| ***A42B 3/12*** | (2006.01) |
| ***A42C 2/00*** | (2006.01) |
| ***F21S 4/20*** | (2016.01) |
| ***F21V 19/00*** | (2006.01) |
| ***F21V 23/00*** | (2015.01) |
| ***F21V 31/04*** | (2006.01) |
| ***F21V 33/00*** | (2006.01) |
| ***F21W 111/10*** | (2006.01) |
| ***F21Y 103/10*** | (2016.01) |
| ***F21Y 115/10*** | (2016.01) |

(52) U.S. Cl.

CPC ..... *A42B 3/0453* (2013.01); *A42B 3/04* (2013.01); *A42B 3/044* (2013.01); *A42B 3/066* (2013.01); *A42B 3/127* (2013.01); *A42C 2/002* (2013.01); *F21S 4/20* (2016.01); *F21V 19/003* (2013.01); *F21V 23/001* (2013.01); *F21V 31/04* (2013.01); *F21V 33/0064* (2013.01); *F21W 2111/10* (2013.01); *F21Y 2103/10* (2016.08); *F21Y 2115/10* (2016.08)

(58) Field of Classification Search

None

See application file for complete search history.

(56) References Cited

U.S. PATENT DOCUMENTS 4,891,736 A * 1/1990 Gouda ..... A42B 3/0453 362/105

5,327,588 A * 7/1994 Garneau ..... A42B 3/044 2/209.13

(Continued)

*Primary Examiner* — Britt D Hanley

(74) *Attorney, Agent, or Firm* — Cheng-Ju Chiang

(57) ABSTRACT

A light-emitting helmet is provided. The helmet includes a main body, a number of fixing members, and a number of light-emitting lamp strips. The main body includes a shell and inner layer. The shell includes an outer surface and a number of grooves defining in the outer surface. The fixing members are secured in the inner layer. The lamp strips are detachably mounted in the grooves by the fixing frames respectively. In addition, a light-emitting helmet manufacturing method is also provided.

10 Claims, 16 Drawing Sheets

(56) References Cited

U.S. PATENT DOCUMENTS

| | | | | |
|---|---|---|---|---|
| 5,416,675 | A * | 5/1995 | DeBeaux | A42B 3/0433 362/106 |
| 5,544,027 | A * | 8/1996 | Orsano | A42B 3/044 2/422 |
| 5,743,621 | A * | 4/1998 | Mantha | A42B 3/044 362/105 |
| 5,871,271 | A * | 2/1999 | Chien | A42B 3/044 362/103 |
| 7,075,250 | B2 * | 7/2006 | Colwell | A42B 3/044 315/185 R |
| 2008/0080171 | A1 * | 4/2008 | Lombard | A42B 3/044 362/106 |
| 2009/0303698 | A1 * | 12/2009 | Huss | A42B 3/0433 362/105 |
| 2010/0177505 | A1 * | 7/2010 | Ho | A42B 3/044 362/106 |
| 2011/0235311 | A1 * | 9/2011 | Stone | A41D 13/01 362/106 |
| 2016/0360817 | A1 * | 12/2016 | Lombard | F21V 33/0008 |

* cited by examiner

LIGHT-EMITTING HELMET AND MANUFACTURING METHOD THEREOF

CROSS-REFERENCE TO RELATED APPLICATION AND CLAIM OF PRIORITY

This application claims priority of a China patent application serial No. 201610010916.4, titled "LIGHT-EMITTING HELMET AND MANUFACTURING METHOD THEREOF" and filed on Jan. 9, 2016, the contents of which are incorporated by reference herein in their entirety for all intended purposes.

TECHNICAL FIELD

The present disclosure relates to a technical field of cycling, in particular to a light-emitting helmet and a manufacturing method thereof.

BACKGROUND

Nowadays, cyclists like to wear a helmet to protect their heads. In use, a helmet is generally required to sustain external impact. Besides, the helmet is suitable to be lighter, thus can be used conveniently. In existing technology, a helmet generally includes a shell made of PC (Polycarbonate) and an inner layer made of lightweight material, such as EPS (Expanded Polystyrene).

For safety and entertainment requirement, a light-emitting lamp strip, such as a LED lamp strip, an OLED lamp strip, or other electroluminescent strip is generally embedded in the helmet. The lamp strips are used to warn other cyclists or a driver in a vehicle in unclear environment (such as dark night). In addition, the lamp strip may emit light in different colors and forms to generate an entertainment effect.

In existing technology, the helmet with light-emitting function is generally manufactured by mounting a light-emitting lamp strip on the helmet, for example, by mounting the light-emitting lamp strip between the inner layer and the shell of the helmet. In this way, the helmet has a beautiful appearance. Besides, the light-emitting lamp strip can be protected by the shell in use. However, in a manufacturing process of the existing light-emitting helmet, the light-emitting lamp strip needs to be secured firstly, and then material of the inner layer is injected to cover the lamp strip. The lamp strip may be easily damaged in an environment of, for example, eight standard atmospheric pressure and 120-180 degrees Celsius high temperature. The damaged lamp strip cannot be repaired, thus production cost of the lamp strip is accordingly increased. In addition, the lamp strip needs to be connected to outside, and the difficulty of molding of the helmet is accordingly increased.

BRIEF DESCRIPTION OF THE DRAWINGS

To illustrate the technical solution according to embodiments of the present disclosure more clearly, drawings to be used in the description of the embodiments are described in brief as follows. However, the drawings described herein are for illustrative purposes only of selected embodiments and not all possible implementations, and are not intended to limit the scope of the present disclosure. Corresponding reference numerals indicate corresponding parts throughout the several views of the drawings.

PREFERRED EMBODIMENTS

Reference will now be made in detail to embodiments, examples of which are illustrated in the accompanying drawings. In the following detailed description, numerous specific details are set forth in order to provide a thorough understanding of the present disclosure. However, it will be apparent to one of ordinary skill in the art that the present disclosure may be practiced without these specific details. In other instances, well-known methods, procedures, components, and circuits have not been described in detail so as not to unnecessarily obscure aspects of the embodiments.

Figure 1:
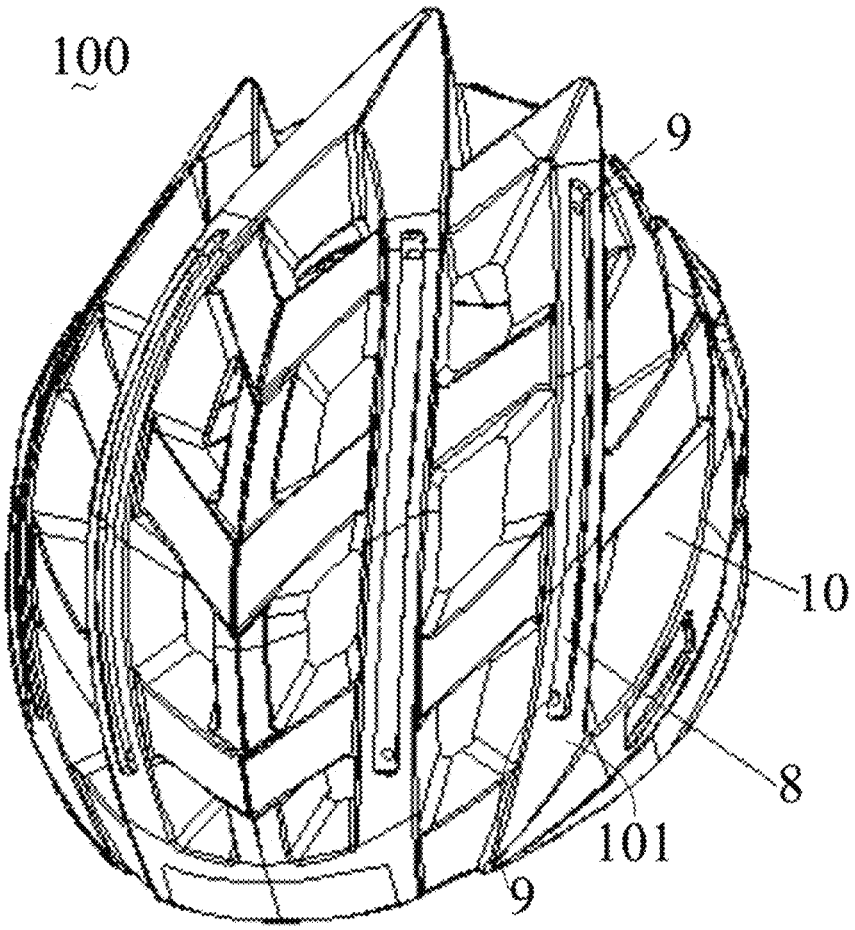
FIG. 1 is a schematic view illustrating a main body of a light-emitting helmet, according to a first embodiment of the present invention.
Figure 2:
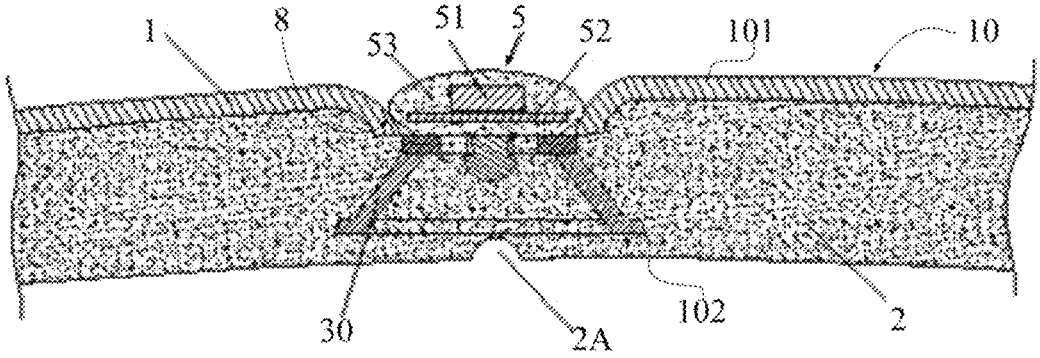
FIG. 2 is a sectional view illustrating the main body with a light-emitting lamp strip and a fixing member mounted thereon.
Figure 3:
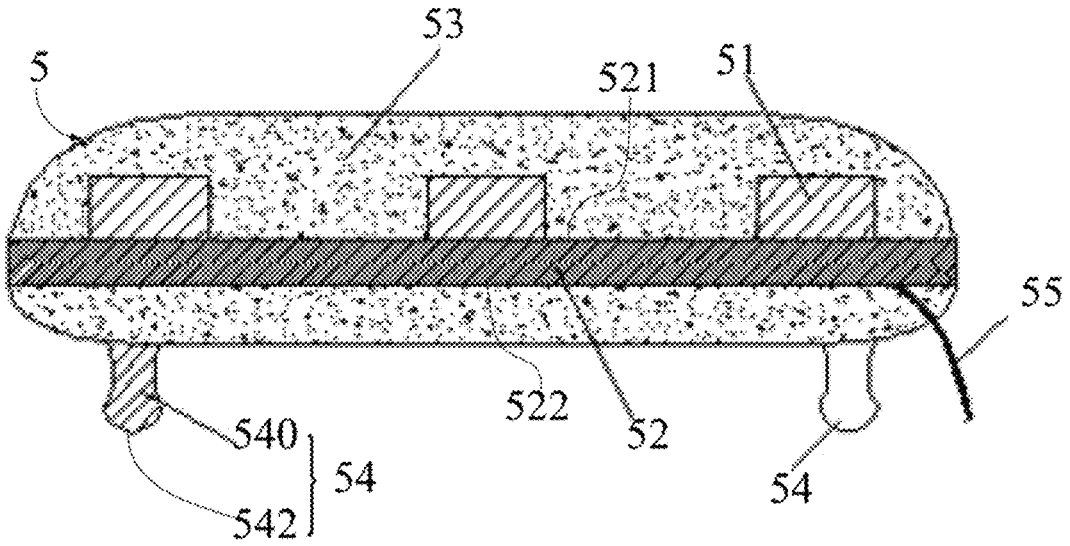
FIG. 3 is a sectional view illustrating the light-emitting lamp strip taken along a length direction thereof.

FIGS. 1-3 illustrate a light-emitting helmet 100 according to a first embodiment of the present invention. The light-emitting helmet 100 includes a main body 10 and a number of light-emitting lamp strips 5 (see FIG. 2). The main body 10 includes a shell 1 and an inner layer 2 (see FIG. 2). The shell 1 is generally made of PC (Polycarbonate), and the inner layer 2 is generally made of EPS (Expanded Polystyrene). The shell 1 includes an outer surface 101. At least one groove 8 is defined in the outer surface 101. In this embodiment, as shown in FIG. 1, four grooves 8 are defined in the outer surface 101, and the grooves 8 are symmetric about a central axis (not shown) of the main body 10. In addition, two holes 9 are defined at a bottom surface (not shown) of the groove 8 at two distal end thereof, respectively. In this embodiment, the groove 8 is elongated.

Referring to FIG. 2 and FIG. 3, each lamp strip 5 includes a circuit board 52, a number of light source 51, an encapsulation layer 53, and a number of protrusions 54 (FIG. 3 shows two protrusions 54 and three light source 51). In this embodiment, the circuit board 52 includes a top surface 521 and s bottom surface 522 at both sides thereof. The light sources 51 are mounted on the top surface 521 of the circuit board 52. The light sources 51 are electrically connected to the circuit board 52. The encapsulation layer 53 is used to encapsulate both the circuit board 52 and the light sources 51, thus protecting the circuit board 52 and the light sources 51. The encapsulation layer 53 is made of transparent material. In use, the light source 51 emits light outwards through the encapsulation layer 53. In this embodiment, the light source 51 can be, for example, a light emitting diode.

The protrusion 54 extends from the encapsulation layer 53. In this embodiment, the protrusion 54 is in a shape of mushroom. That is, the protrusion 54 includes a connecting rod 540 and a head 542. The connecting rod 540 is generally cylinder shaped, and is connected between the encapsulation layer 53 and the head 542. The head 542 is hemisphere shaped, and protrudes from the connecting rod 540.

In this embodiment, the encapsulation layer 53 and the protrusions 54 can be integrally made. In alternative embodiments, the protrusion 54 and the encapsulation layer 53 may be made separately. In use, the protrusion 54 is connected to the encapsulation layer 53 by using adhesive, for example.

As shown in FIG. 3, the lamp strip 5 includes a control wire 55 at one end thereof. The control wire 55 is connected to a bottom surface 522 of the circuit board 52, and extends outside the encapsulation layer 53. The distal end of the control wire 55 can be connected to the controller 7 (see FIG. 8) easily by a wire 3 (see FIG. 10). The controller 7 is mounted to the main body 10 at a front side thereof.

In use, a fixing frame 30(see FIG. 2) is provided to fix the lamp strip 5 in the groove 8, and the control wire 55 can be connected to a controller 7 (shown in FIG. 8) by passing through the hole 9.

Figure 4:
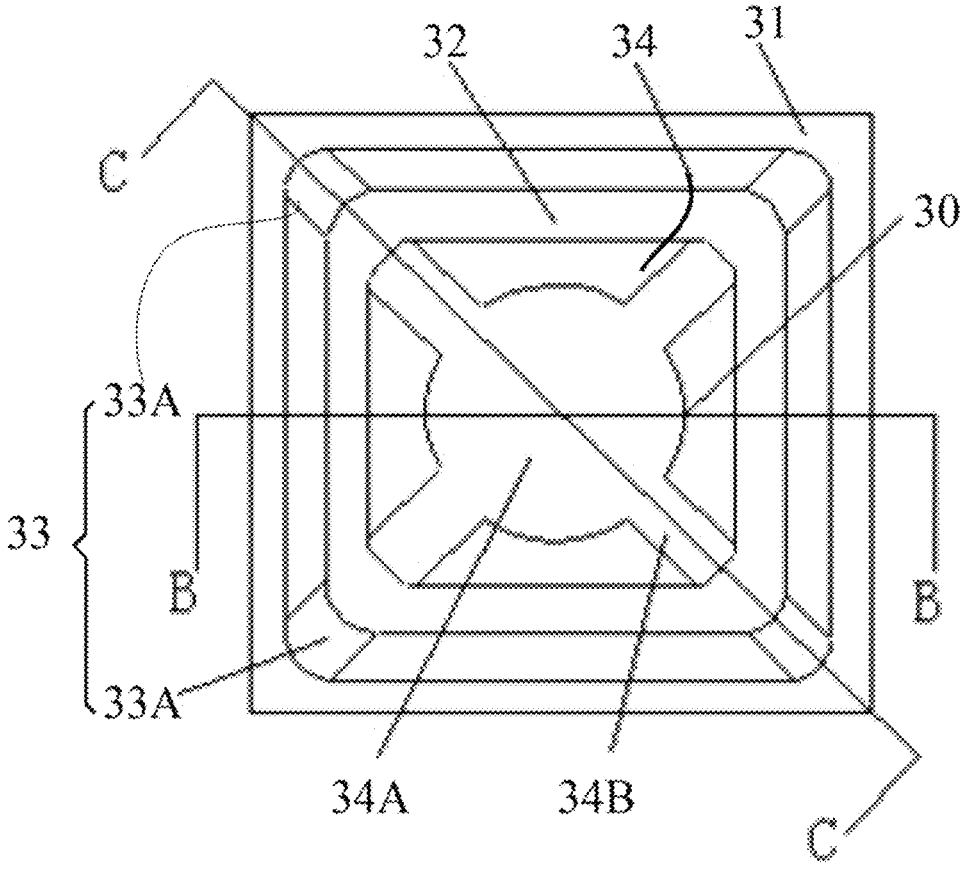
FIG. 4 is a top view of the fixing member of FIG. 2.
Figure 5:
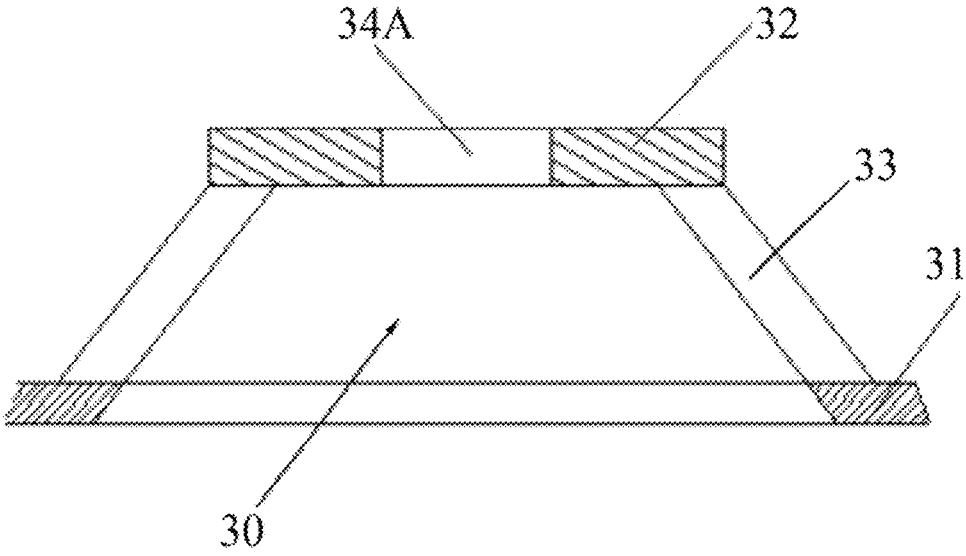
FIG. 5 is a sectional view of the fixing member taken along a B-B line shown in FIG. 4.
Figure 6:
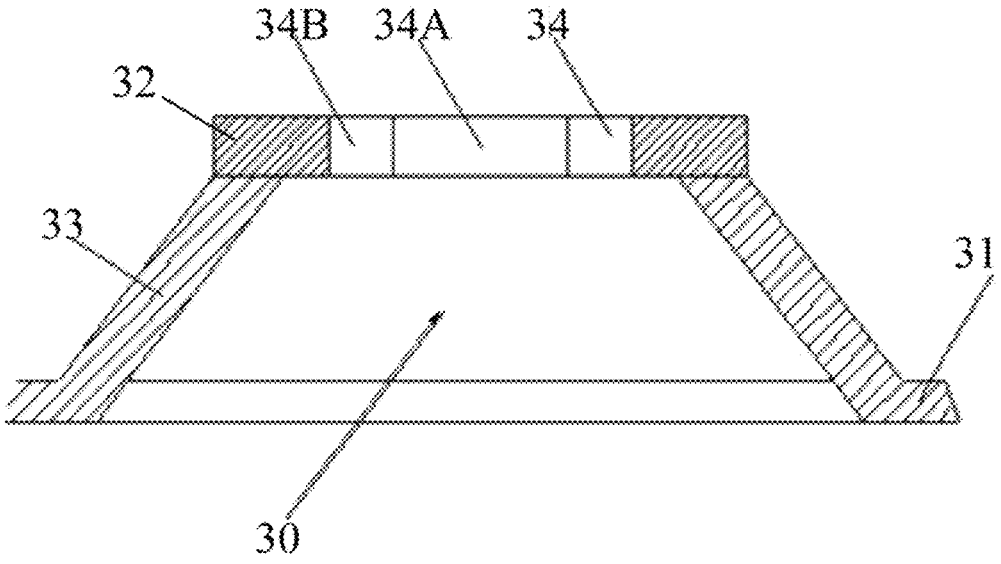
FIG. 6 is a sectional view of the fixing member taken along a C-C line shown in FIG. 4.

Referring to FIG. 2, FIG. 3, FIG. 4, FIG. 5, and FIG. 6, the fixing frame 30 includes a base 31, an engaging member 32, and a supporting member 33. The supporting member 33 is connected between the engaging member 32 and the base 31. The engaging member 32 is supported by the supporting member 33. The engaging member 32 and the base 31 each are substantially rectangular. In this embodiment, the supporting member 33 includes four supporting bars 33A (FIG. 4). A dimension of the base 31 is greater than that of the engaging member 32. The four supporting bars 33A extend upwards from four corners of the base 31 to four corners of the engaging member 32.

The fixing frame 30 further includes a plate 34 (see FIG. 4 and FIG. 6) extends from an inner surface of the supporting member 33. A cavity 34A is defined in the middle of the plate 34. Four slots 34B are defined at four corners of the plate 34. The slots 34B communicate with the cavity 34A. Longitudinal directions of the slots 34B are perpendicular with each other. A diameter of the cavity 34A is similar to that of the connecting rod 540. In this embodiment, the cavity 34A and the slots 34B divide the plate 34 into four elastic portions to engage the protrusion 54 tightly in the cavity 34A.

Figure 7:
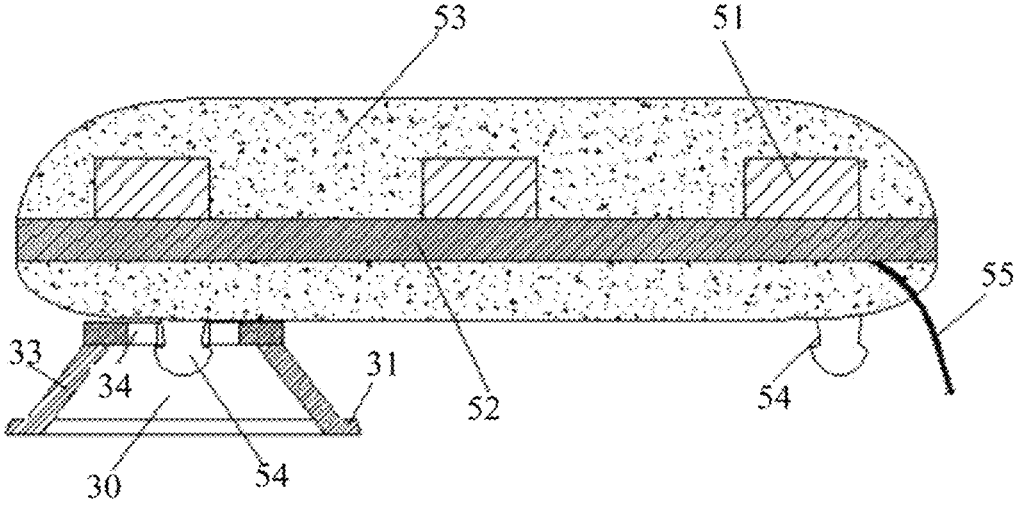
FIG. 7 is a sectional view illustrating the light-emitting lamp strip and the fixing member taken along a length direction thereof.

Referring to FIG. 7, the fixing frame 30 are buried in the inner layer 2 in use, and the lamp strip 5 is mounted in the groove 8 by engaging the protrusion 54 tightly in the cavity 34A of the fixing frame 30. In this way, the lamp strip 5 is mounted to the main body 10 by the fixing frame 30. In this embodiment, an adhesive layer (not shown) may be further used to cover the lamp strip 5 in the groove 8.

In alternative embodiment, the fixing frame 30 may have other shape. For example, the supporting bar 33A may be wave-shaped, tooth-shaped to increase a contact surface with the inner layer 2. In this way, the fixing frame 30 can be secured to the main body 10 firmly.

Referring to FIGS. 1-2, a depth of the groove 8 can be slightly smaller than a height of the light-emitting lamp strip 5. In this way, the lamp strip 5 may protrude the outer surface 101 of the main body 10. Thus, the light source 51 emits light outwards the encapsulation layer 53 widely.

As the lamp strips 5 and the main body 10 are made separately and then assembled together, if the lamp strip 5 or the main body 10 is damaged in use, either the lamp strip 5 or the main body 10 can be separated and then repaired respectively. In this manner, cost of the helmet 100 can be reduced efficiently.

Figure 8:
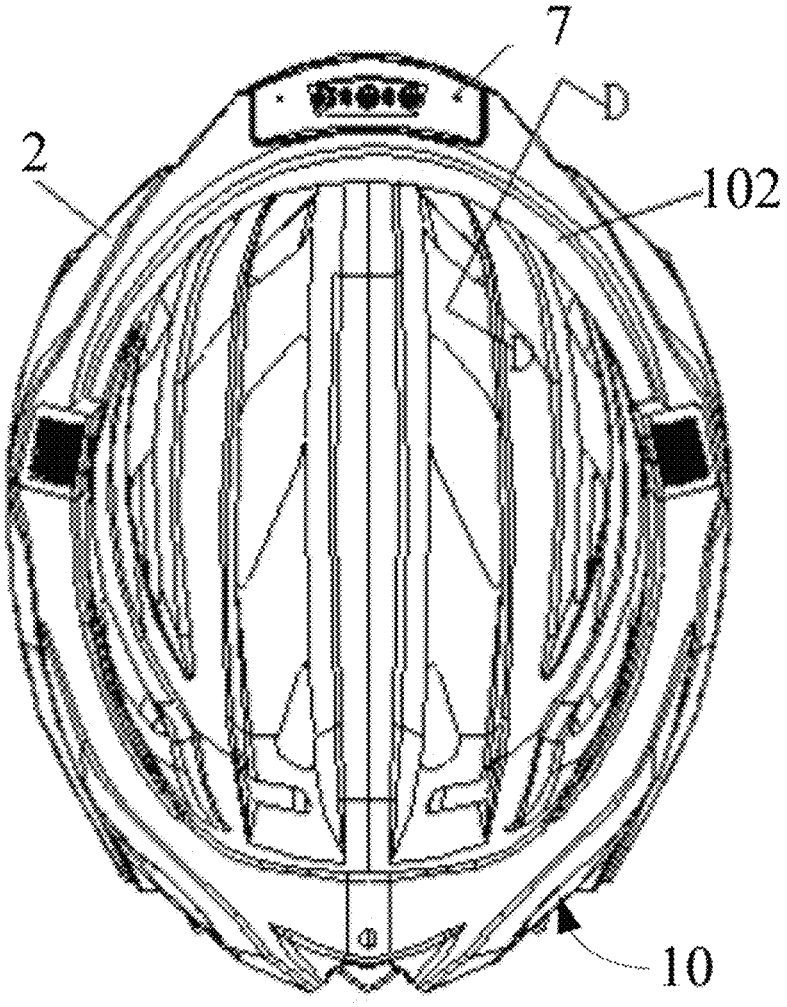
FIG. 8 is a bottom view of the main body of FIG. 1.

Referring to FIG. 7 and FIG. 8, a wire 3 (shown in FIG. 10) is used to be connected between the control wire 55 (shown in FIG. 7) and the controller 7 (shown in FIG. 8). Accordingly, a first wire groove 2A (shown in FIG. 2) may be defined in an inner surface 102 of the main body 10 facing away from the outer surface 101. The first wire groove 2A communicates with the hole 9 (shown in FIG. 1). In this embodiment, the first wire groove 2A is used to fittingly receive the wire 3.

Figure 9:
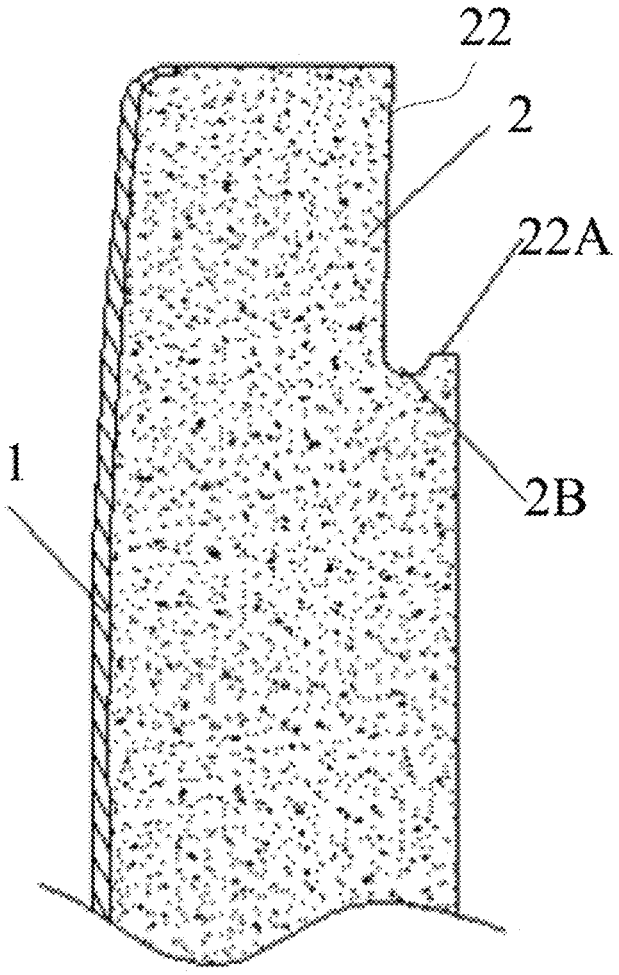
FIG. 9 is a sectional view taken along a D-D line of FIG. 8, showing a step being defined in an inner surface of the main body.
Figure 10:
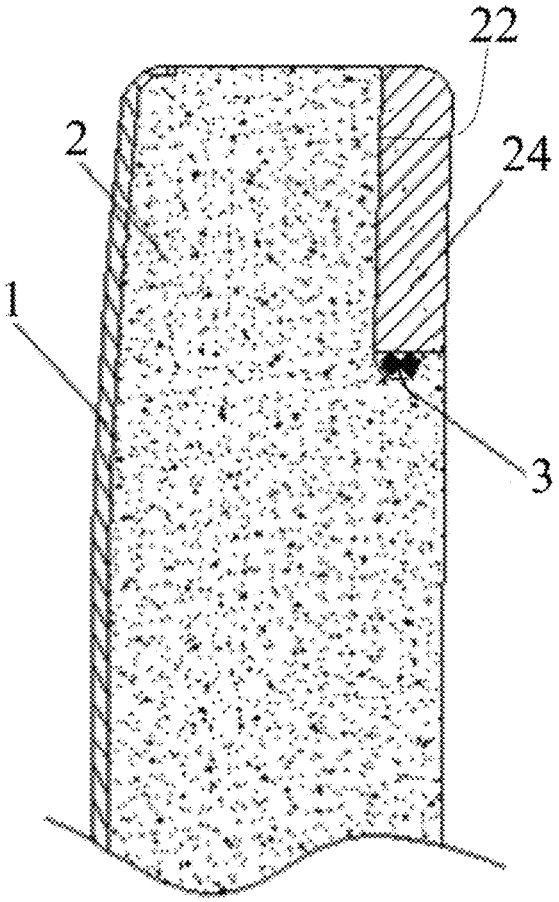
FIG. 10 is a sectional view of the main body of FIG. 9, showing a cushion being attached to the step.

As shown in FIGS. 9-10, in alternative embodiment, a step 22 is defined in the inner surface 102 of the inner layer 2 at an edge thereof. A second wire groove 2B is defined in a peripheral surface 22A of the step 22. In use, the second wire groove 2B is used to fittingly receive the wire 3. In addition, a cushion 24 (see FIG. 10) is provided and used to be fittingly received in the step 22. In use, the cushion 24 can be attached to the inner layer 2 by, for example, a velcro. In this embodiment, the cushion 24 can be made of elastic material, such as rubber material to protect the cyclist' head.

Figure 11:
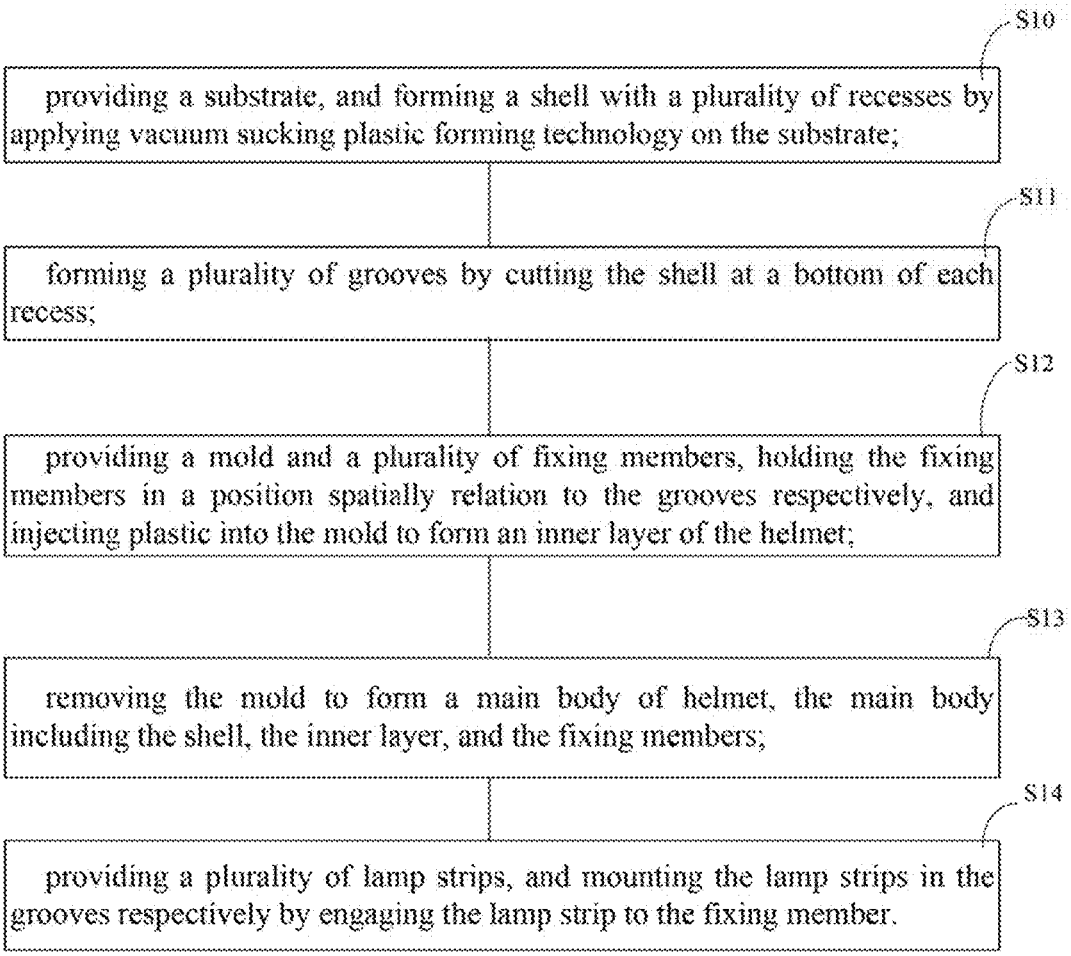
FIG. 11 is a flowchart of a manufacturing method for a light-emitting helmet, according to a second embodiment.

Referring to FIG. 11, a manufacturing method for manufacturing the light-emitting helmet 100 is shown. The manufacturing method includes steps S10-S14.

Figure 12:
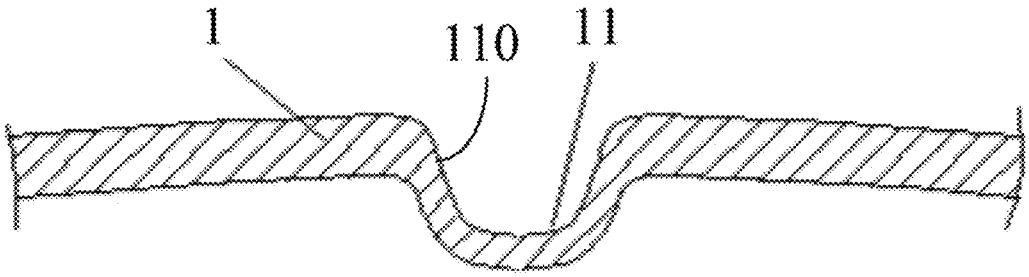
FIG. 12 is a sectional view of a shell in a processing step 10 of FIG. 11.
Figure 13:
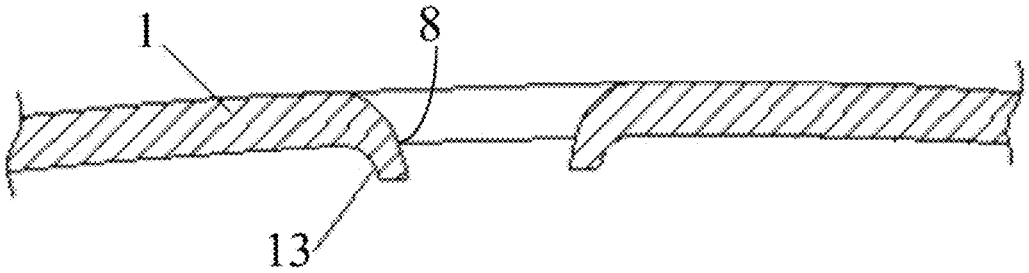
FIG. 13 is a sectional view of the shell in a processing step 11 of FIG. 11.

Referring to FIGS. 12-13, in step S10, a substrate made of PC is provided to form a shell 1 with a number of recesses 11 by using vacuum sucking plastic forming technology.

In step S11, a number of grooves 8 (see FIG. 3) is formed by cutting the shell 1 at a bottom 110 of the recess 11. In step S10 a curve portion 13 is formed when applying cutting process. The curve portion 13 may prevent EPS of the inner layer 2 from overflowing in step 12.

In step S12, a mold (not shown) is provided to hold a number of fixing members 30 in a position spatially relation to the grooves 8 respectively, and plastic, such as EPS is injected into the mold to form an inner layer 2 of the helmet 100. In the process of forming the inner layer 2, a number of pins (not shown) are mounted to the mold.

Figure 14:
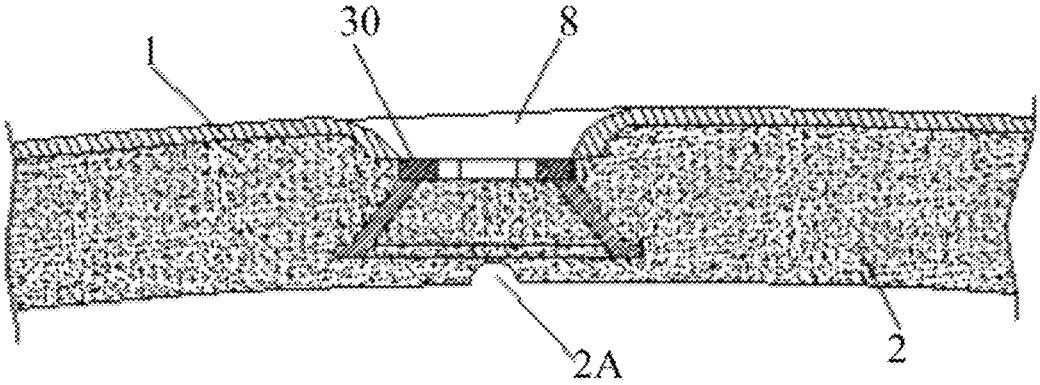
FIG. 14 is a sectional view of the shell, an inner surface, and a fixing member in a processing step 12 of FIG. 11.

Referring to FIG. 14, in step S 13, the mold is removed, and a main body 10 with the shell 1 and the inner layer 2, together with the fixing members 30 is formed. In this embodiment, as the pins are provided in the injection molding process of step 11, thus a hole 9 (see FIG. 1) for receiving the control wire 55 is accordingly formed. In addition, in the injection molding process of step 11, a wire groove 2A is also formed to receive the wire 3 (see FIG. 10).

Figure 15:
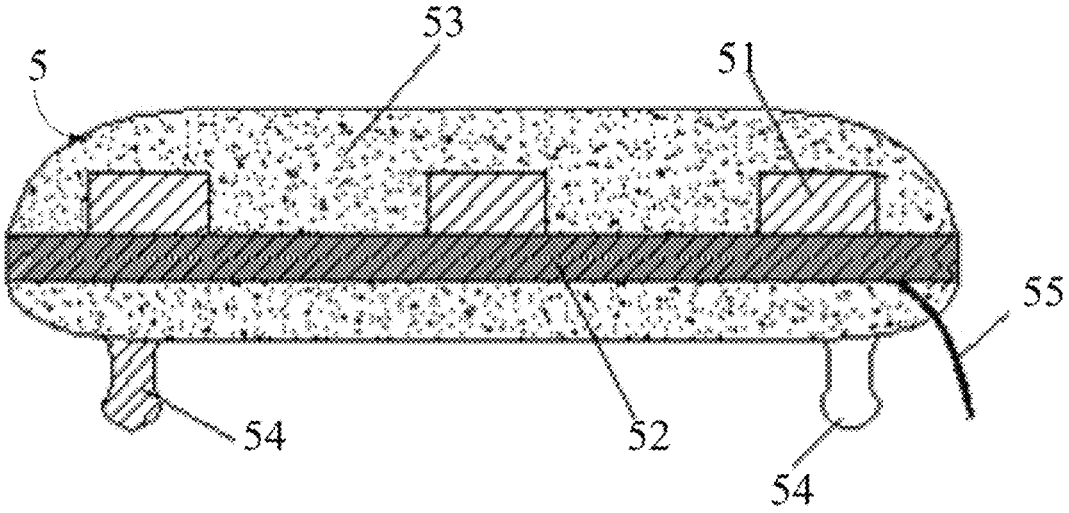
FIG. 15 is a sectional view illustrating a light-emitting lamp strip in a processing step 13 of FIG. 11.
Figure 16:
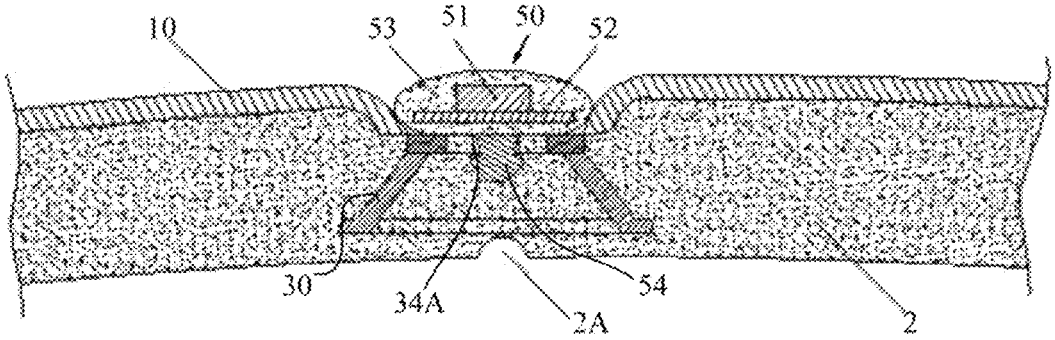
FIG. 16 is a sectional view illustrating the helmet in a processing step 14 of FIG. 11.

Referring to FIG. 15 and FIG. 16, in step 14, a number of lamp strips 5 are provided. Each lamp strip 5 includes a circuit board 52, a number of light source 51, an encapsulation layer 53, and a number of protrusions 54. In this embodiment, the lamp strip 5 is mounted in the groove 8 by engaging the protrusion 54 tightly in the cavity 34A of the fixing frame 30 (see FIG. 16). That is, the lamp strip 5 is mounted to the main body 10 by the fixing frame 30. In this embodiment, before the lamp strip 5 is mounted, the control wire 55 can be used to pass through the hole 9 (see FIG. 1).

Besides, when the lamp strip 5 is mounted, an adhesive layer (not shown) may be further used to cover the lamp strip 5 in the groove 8.

The method may further include a step S15. In step 15, the wire 3 (see FIG. 10) is received in the second wire groove 2B (see FIG. 9), and is connected to both the control wire 55 and the controller 7 (see FIG. 8).

By applying steps S10-S15, the light-emitting helmet 100 is made.

The contents described above are only preferred embodiments of the present disclosure, but the scope of the present disclosure is not limited to the embodiments. Any ordinarily skilled in the art would make any modifications or replacements to the embodiments in the scope of the present disclosure, and these modifications or replacements should be included in the scope of the present disclosure. Thus, the scope of the present disclosure should be subjected to the claims.

What is claimed is:

1. A light-emitting helmet, comprising:

a main body including a shell and inner layer formed on the shell, the shell including an outer surface and a plurality of grooves defining in the outer surface;

a plurality of fixing members secured in the inner layer; and a plurality of light-emitting lamp strips detachably mounted in the grooves by the fixing frames respectively; and each lamp strip comprises:

a circuit board;

a plurality of light source mounted on the circuit board;

an encapsulation layer encapsulating the circuit board and the light sources; and at least one protrusion extends from the encapsulation layer.

2. The light-emitting helmet of claim 1, wherein the light source is a light emitting diode.

3. The light-emitting helmet of claim 1, wherein each fixing member comprises:

a base;

an engaging member receiving the at least one protrusion; and a supporting member connected between the engaging member and the base, and the supporting member being configured for supporting the engaging member.

4. The light-emitting helmet of claim 3, wherein the base and engaging member each are rectangular, and the supporting member includes four supporting bars extending upwards from four corners of the base to four corners of the engaging member.

5. The light-emitting helmet of claim 4, wherein the fixing member further comprises a plate extending from an inner surface of the supporting member, and a cavity is defined in the middle of the plate, and four slots are defined at four corners of the plate, the slots communicate with the cavity, and the cavity is configured for receiving the protrusion.

6. The light-emitting helmet of claim 5, wherein longitudinal directions of the slots are perpendicular with each other.

7. The light-emitting helmet of claim 1, further comprising a controller mounted to the main body, wherein a hole is defined in a bottom surface of the groove, and the lamp strip includes a control wire passing through the hole and connected to the controller.

8. The light-emitting helmet of claim 7, wherein the main body comprises an inner surface facing away from the outer surface, and a first wire groove is defined in the inner surface of the main body, and the first wire groove communicates with the hole.

9. The light-emitting helmet of claim 7, wherein the main body comprises an inner surface facing away from the outer surface, and a step is defined in the inner surface, and a second wire groove is defined in a peripheral surface of the step.

10. The light-emitting helmet of claim 9, further comprising a cushion fittingly received in the step.

* * * * *